US009877515B2

(12) United States Patent
Liu

(10) Patent No.: US 9,877,515 B2
(45) Date of Patent: Jan. 30, 2018

(54) ELECTRONIC CIGARETTE

(71) Applicant: HUIZHOU KIMREE TECHNOLOGY CO., LTD. SHENZHEN BRANCH, Shenzhen, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 0 days.

(21) Appl. No.: 14/901,116

(22) PCT Filed: Jun. 26, 2013

(86) PCT No.: PCT/CN2013/078021
§ 371 (c)(1),
(2) Date: Dec. 28, 2015

(87) PCT Pub. No.: WO2014/205687
PCT Pub. Date: Dec. 31, 2014

(65) Prior Publication Data

US 2016/0150826 A1 Jun. 2, 2016

(51) Int. Cl.
*A61H 33/12* (2006.01)
*D06F 75/00* (2006.01)
(Continued)

(52) U.S. Cl.
CPC ..... *A24F 47/008* (2013.01); *H05B 3/03* (2013.01); *H05B 2203/021* (2013.01)

(58) Field of Classification Search
CPC .... A24F 47/008; A24F 47/002; A24F 47/006; A24B 15/16; A61M 11/042;
(Continued)

(56) References Cited

U.S. PATENT DOCUMENTS 5,970,211 A * 10/1999 Ritsher ..... F24F 6/12 392/337
2011/0303231 A1* 12/2011 Li ..... A24F 47/008 131/329
(Continued)

FOREIGN PATENT DOCUMENTS

CN 201238610 Y * 5/2009
CN 201750712 U * 2/2011
(Continued)

OTHER PUBLICATIONS

CN201238610Y Machine Translation, Haoran Xia, Environmental-protecting type non-ignitability atomizing electronic cigarette with function of cigarette substitute article, May 20, 2009.*
(Continued)

*Primary Examiner* — Tu B Hoang
*Assistant Examiner* — Joseph Baillargeon

(57) ABSTRACT

An electronic cigarette, comprising a casing and an electrode assembly disposed therein; the electrode assembly comprising an outer electrode (30) and an inner electrode (40), which are insulated from each other; outer electrode (30) being provided with a first through-hole (312); inner electrode (40) being provided with a second through-hole (412); first through-hole (312) and second through-hole (412) communicating to form the gas flow communication channel of the electronic cigarette. The electronic cigarette causes gas to flow directly from the first through-hole (312) to the second through-hole (412), thus shortening the flow path of the gas, making gas flow changes more smoothly, and reducing noise when smoking, improving user experience.

16 Claims, 5 Drawing Sheets

(51) Int. Cl.
*F17C 7/04* (2006.01)
*A24F 47/00* (2006.01)
*H05B 3/03* (2006.01)

(58) Field of Classification Search
CPC ..... A61M 15/0035; A61M 15/0001; A61M 15/06; A61M 15/0003; A61M 15/0066; A61M 15/0033; A61M 15/0021; B05B 7/2402; H05B 3/0014; H05B 1/0244
USPC ..... 392/404, 403, 386; 131/178, 194, 191, 131/325, 328, 329; 219/494
See application file for complete search history.

(56) References Cited

U.S. PATENT DOCUMENTS

2011/0304282 A1* 12/2011 Li ..... A24F 47/008 315/362
2012/0145169 A1* 6/2012 Wu ..... A24F 47/008 131/273
2014/0290677 A1* 10/2014 Liu ..... A61M 15/06 131/329
2014/0299139 A1* 10/2014 Liu ..... A24F 47/008 131/329
2014/0299140 A1* 10/2014 Liu ..... A61M 15/06 131/329
2014/0332021 A1* 11/2014 Li ..... A24F 47/008 131/329
2014/0334803 A1* 11/2014 Li ..... H05B 3/03 392/394

FOREIGN PATENT DOCUMENTS

KR 10-2012-0132005 A 12/2012
KR 20120132005 A * 12/2012

OTHER PUBLICATIONS

CN201750712U Machine Translation, Zhiping Chen, Suction nozzle of electronic atomizing inhaler, Feb. 23, 2011.*
International Search Report of PCT Patent Application No. PCT/CN2013/078021 dated Mar. 27, 2014.

* cited by examiner

ELECTRONIC CIGARETTE

TECHNICAL FIELD

The present application relates to the technical field of electrical heating, and more particularly, relates to an electronic cigarette.

BACKGROUND

As a hobby, smoking is very popular with people, especially men. However, tar in cigarette is harmful to human health, and dozens of compositions thereof are carcinogens. Besides, secondhand smoke does a great harm to non-smokers. Therefore, there is a regulation to prohibit smoking in most of public places. However, it is very difficult for a smoker not to smoke. Accordingly, electronic cigarettes, used as substitutes for conventional tobaccos, have been widely used.

As shown in FIG. 1, in an existing electronic cigarette, an inlet channel is defined in a casing of the electronic cigarette. External gas enters the electronic cigarette through the inlet channel, further flows into a recess defined at the bottom end of an upper electrode, and finally flows into atomization channel and brings atomized smoke to the suction nozzle for the smoker to suck in. The arrow direction shown in FIG. 1 directs to a gas flowing direction. It can be seen from the figure that, after the external gas enters the electronic cigarette, the gas needs to make a couple of 90 degree turns before entering the atomization channel. In this way, the gas flow changes strongly, and the flow path of the gas is long since the gas needs to flow from the inlet channel to the bottom end of the upper electrode. Besides, a lot of noises may be produced when the smoker is smoking, and thus the user experience is affected.

BRIEF SUMMARY

The objective of the present application is to provide an electronic cigarette which can effectively reduce noises when smoking and improve user experience, aiming at the drawbacks in the prior art that the flow path of the gas is long, and a lot of noises may be produced.

In accordance with one aspect of the present application, an electronic cigarette is provided, which comprises a casing and an electrode assembly disposed therein; the electrode assembly comprising an outer electrode and an inner electrode which are insulated from each other; wherein the outer electrode is provided a first through-hole, and the inner electrode is provided with a second through-hole; the first through-hole and the second through-hole are communicated with each other to form a gas flow communication channel of the electronic cigarette.

In the electronic cigarette of the present application, the casing includes an atomization sleeve and a battery sleeve; an abutment joint between the atomization sleeve and the battery sleeve forms an inlet channel allowing the gas to flow into the electronic cigarette.

In the electronic cigarette of the present application, the outer electrode includes an external thread sleeve and an internal thread sleeve which are connected to each other by a threaded connection; the first through-hole is defined on the external thread sleeve.

In the electronic cigarette of the present application, the gas flow communication channel formed by the first through-hole and the second through-hole is in shape of an arc.

In the electronic cigarette of the present application, the gas flow communication channel formed by the first through-hole and the second through-hole is linear, and an angle between the gas flow communication channel and an axial direction of the casing is less than 90°.

In the electronic cigarette of the present application, the number of the first through-holes is less than the number of the second through-holes.

In the electronic cigarette of the present application, the inner electrode includes an upper electrode and a lower electrode; the second through-hole is defined on a side wall of the upper electrode or the lower electrode.

In the electronic cigarette of the present application, the upper electrode includes a first barrel and a second barrel, wherein the second barrel extends from an end portion of the first barrel; an inner diameter of the second barrel is less than an inner diameter of the first barrel; the second through-hole is defined on the side wall of the first barrel.

In the electronic cigarette of the present application, the external thread sleeve includes a main body and a connecting portion, the main body is sleeved in the atomization sleeve; an external thread is formed on the connecting portion; the first through-hole is defined at a joint between the connecting portion and the main body.

In the electronic cigarette of the present application, the electronic cigarette further includes a first insulating ring disposed between the main body and the second barrel.

In the electronic cigarette of the present application, the internal thread sleeve is sleeved in the battery sleeve; an internal thread is formed on the internal thread sleeve in a position corresponding to the external thread, and the internal thread and the external thread are connected to each other by a thread connection.

In the electronic cigarette of the present application, at least two second through-holes are defined in the upper electrode, and the second through-holes are separated from each other.

In the electronic cigarette of the present application, the second through-holes have a same diameter, and are separately defined on the side wall of the upper electrode at an equal interval.

In the electronic cigarette of the present application, the lower electrode includes a third barrel and a fourth barrel, wherein the fourth barrel extends from an end portion of the third barrel; an inner diameter of the fourth barrel is less than an inner diameter of the third barrel; the second through-hole is defined on the side wall of the third barrel.

In the electronic cigarette of the present application, the external thread sleeve includes a main body and a connecting portion; the main body is sleeved in the battery sleeve; an external thread is formed on the connecting portion; the first through-hole is defined at a joint between the connecting portion and the main body.

In the electronic cigarette of the present application, the electronic cigarette further includes a second insulating ring disposed between the main body and the fourth barrel.

In the electronic cigarette of the present application, the internal thread sleeve is sleeved in the battery sleeve; an internal thread is formed on the internal thread sleeve in a position corresponding to the external thread, and the internal thread and the external thread are connected to each other by a thread connection.

In the electronic cigarette of the present application, at least two second through-holes are defined in the lower electrode, and the second through-holes are separated from each other.

In the electronic cigarette of the present application, the second through-holes have a same diameter, and are separately defined on the side wall of the lower electrode at an equal interval.

When implementing the electronic cigarette of the present application, the following advantageous can be achieved: by defining the first through-hole on the external electrode, defining the second through-hole on the inner electrode, and further making the first through-hole and the second through-hole communicated with each other to form a gas flow communication channel, the gas entering the electronic cigarette successively flows through the first through-hole and the second through-hole, and finally flows into the atomization channel. Since the second through-hole is defined on the side wall of the inner electrode, the flow path of the gas is shortened when the gas flows from the first through-hole to the second through-hole, the gas flow changes more smoothly, the noises produced in the smoking process are reduced, and thus the user experience is improved.

BRIEF DESCRIPTION OF THE DRAWINGS

The present application will be further described with reference to the accompanying drawings and embodiments in the following, in the accompanying drawings.

DETAILED DESCRIPTION OF THE PREFERRED EMBODIMENT

In order to make the technical features, the propose and the technical effect of the present application more clearly, the specific implemental means of the present application will now be described in detail with reference to the accompanying drawings.

Figure 1:
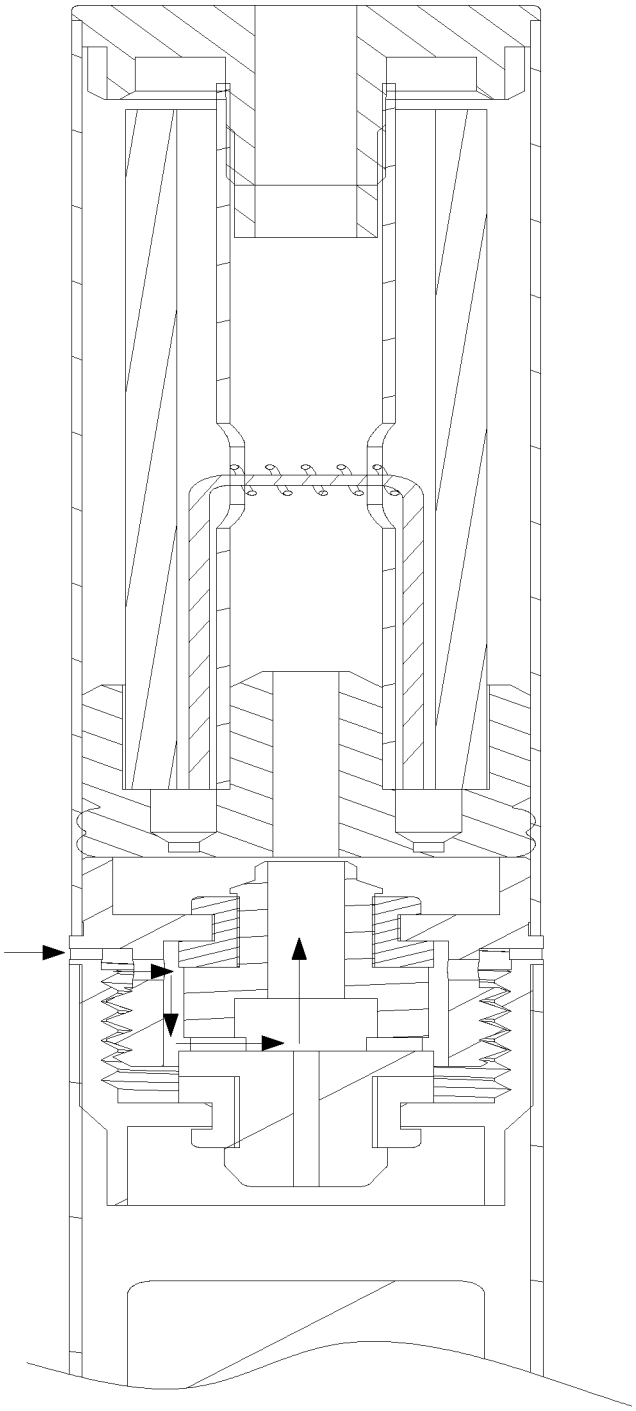
FIG. 1 illustrates a partially cutaway view of an electronic cigarette in the prior art.
Figure 2:
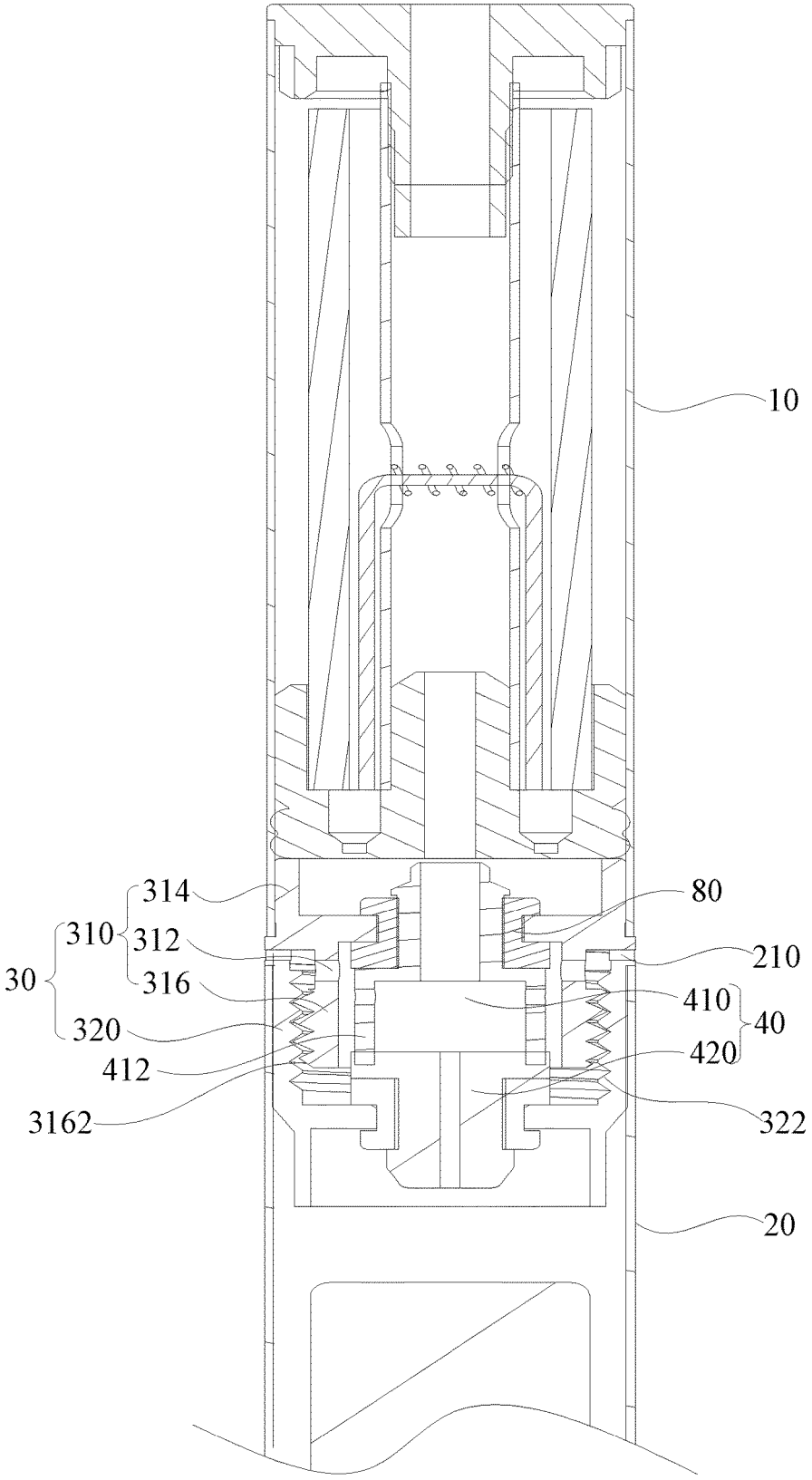
FIG. 2 illustrates a partially cutaway view of an electronic cigarette according to a first embodiment of the present application.

As shown in FIG. 2, a preferred embodiment of the present application provides an electronic cigarette, which comprises a casing (not shown here), and an electrode assembly (not shown here). In this case, the electrode assembly is disposed in the casing.

An inlet channel 210 is defined in the casing, and the inlet channel 210 provided allows external gas to flow into the electronic cigarette. In this embodiment, the casing includes an atomization sleeve 10 and a battery sleeve 20. That is, the casing of the electronic cigarette consists of the atomization sleeve 10 and the battery sleeve 20. Further, the atomization sleeve 10 is not integrated with the battery sleeve 20, such that an abutment joint between the atomization sleeve 10 and the battery sleeve 20 forms the inlet channel 210 allowing the gas to flow therein.

The electrode assembly comprises an outer electrode 30 and an inner electrode 40 which are insulated from each other. The outer electrode 30 is provided with a first through-hole 312, and the inner electrode 40 is provided with a second through-hole 412. The first through-hole 312 and the second through-hole 412 are communicated with each other, allowing gas entering the electronic cigarette from the inlet channel 210 to flow through the electronic cigarette. That is, the first through-hole 312 and the second through-hole 412 are communicated with each other to form a gas communication channel inside the electronic cigarette.

In the present embodiment, the outer electrode 30 includes an external thread sleeve 310 and an internal thread sleeve 320. The external thread sleeve 310 is connected to the internal thread sleeve 320 by a threaded connection, and the first through-hole 312 is defined on the external thread sleeve 310.

The inner electrode 40 includes an upper electrode 410 and a lower electrode 420, and the upper electrode 410 is abutted against the lower electrode 420. In this embodiment, it is possible for the second through-hole 412 to be defined on a side wall of the upper electrode 410. However, it is also possible for the second through-hole 412 to be defined on a side wall of the lower electrode 420.

In the electronic cigarette of the present application, the second through-hole 412 is defined on the side wall of the upper electrode 410 or of the lower electrode 420; besides, the inlet channel 210, the first through-hole 312 and the second through-hole 412 are communicated with each other to form a gas flow communication channel. In this way, the gas entering the electronic cigarette successively flows through the first through-hole 312 and the second through-hole 412, and finally flows into the atomization channel. Since the second through-hole 412 is defined on the side wall of the upper electrode 410 or of the lower electrode 420, the flow path of the gas is shortened when the gas flows from the first through-hole 312 to the second through-hole 412, the gas flow changes more smoothly, noises produced in the smoking process are reduced, and thus user experience is improved.

A vertical distance from a central line of the second through-hole 412 to a central line of the first through-hole 312 is 0-1 cm. That is, the vertical distance from the central line of the second through-hole 412 to the a central line of the first through-hole 312 is less than a vertical distance from a bottom end of the upper electrode 410 or of the lower electrode 420 to the central line of the first through-hole 312. In this way, when the gas flows from the first through-hole 312 to the hollow interior of the inner electrode 40, the flow path is relative small. Furthermore, collisions with the atomizer and the battery rod are reduced, such that the gas flow changes more smoothly, the noises produced in the smoking process are reduced, and thus the user experience is improved. When the vertical distance from the first through-hole 312 to the second through-hole 412 is short, the gas flow communication channel formed by the first through-hole 312 and the second through-hole 412 is linear. That is, a connection line between a centre of the first through-hole 312 and a centre of the second through-hole 412 is a tilted straight line, and thus it is possible for the gas flow to directly flow from the first through-hole 312 to the second through-hole 412 via the tilted straight line. Besides, an angle between the tilted straight line and an axial direction of the casing is less than 90°. In a further embodiment, it is possible for the gas flow communication channel formed by the first through-hole 312 and the second through-hole 412 to be in shape of an arc. That is, when the vertical distance from the first through-hole 312 to the second through-hole 412 is relative long, an arc gas flow communication channel is formed by the first through-hole 312 and the second through-hole 412. Preferably, the first through-hole 312 and the second through-hole 412 are correspondingly parallel to each other. In this way, the gas flow may directly flow from the first through-hole 312 to the second through-hole 412, without vertically flowing through the gap formed between the inner electrode 40 and the outer electrode 30. Therefore, the gas flow changes smoothly, the noises are reduced, and the user experience is improved.

It could be understood that, the number of the second through-holes 412 defined on the inner electrode 40 is larger than that of the first through-hole 312 defined on the outer electrode 30. In this way, a plurality of channels may be provided for the gas flow, and thus the gas flows smoothly in the electronic cigarette, and the noises are reduced.

Figure 3:
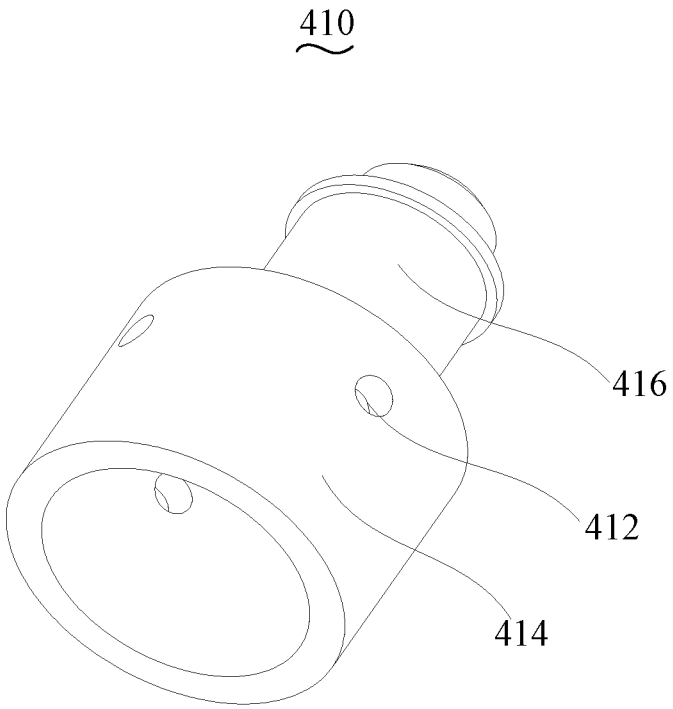
FIG. 3 illustrates an upper electrode shown in FIG. 2.

As shown in FIGS. 2-3, in the electronic cigarette provided in the first embodiment of the present application, the second through-hole 412 is defined on the side wall of the upper electrode 410. The upper electrode 410 is substantially in shape of a hollow cylinder, and includes a first barrel 414 and a second barrel 416. The second barrel 416 extends from an end portion of the first barrel 414, and an inner diameter of the second barrel 416 is less than an inner diameter of the first barrel 414, and the first barrel 414 and the second barrel 416 have a common axis. Specifically, the second through-hole 412 is defined on the side wall of the first barrel 414. After the gas enters the electronic cigarette from the inlet channel 210, the gas flows through the second through-hole 412 defined on the side wall of the upper electrode 410, and the finally flows into the atomization channel. Compared with the electronic cigarette in the prior art, when using the electronic cigarette of the present application, there is no need for the gas to flow to the bottom end of the upper electrode 410, such that the flow path of the gas is shortened, the drawback that the gas is collided with the atomizer or the battery rod is prevented from occurring, the noises produced in the smoking process are effectively reduced, and thus the user experience is improved.

It could be understood that, one, two, or more second through-holes 412 may be defined in the present application. Therefore, the number of the second through-holes 412 is not limited here, and the number of the second through-holes 412 may be adjusted depending on the requirements to the amount of the smoke when manufacturing the electronic cigarette. In a case that two or more second through-holes 412 are defined in the upper electrode 410, the two or more second through-holes 412 are separately defined on the side wall of the upper electrode 410. In a specific case, the second through-holes 412 may be separated from each other at an equal interval or at an unequal interval. Preferably, a plurality of second through-holes 412 having a same diameter are separately defined on the side wall of the upper electrode 410 at an equal interval.

The external thread sleeve 310 of the present application is substantially in shape of a hollow cylinder, and the upper electrode 410 is disposed inside the external thread sleeve 310. The external thread sleeve 310 includes a main body 314, a connecting portion 316, a joint (not shown here) and a first through-hole 312. In this case, the main body 314 is sleeved in the atomization sleeve 10 and is further abutted against the atomization sleeve 10. That is, the external thread sleeve 310 is disposed between the atomization sleeve 10 and the upper electrode 410. An external thread 3162 is formed on the connecting portion 316, and the joint is formed between the main body 314 and the connecting portion 316. The first through-hole 312 is defined at the joint. The electronic cigarette of the present application further includes a first insulating ring 80. The main body 314 is connected to the second barrel 416 of the upper electrode 410 via the first insulating ring 80, in such a way that the upper electrode 410 and the external thread sleeve 310 are fixedly connected to each other.

The internal thread sleeve 320 is in shape of a hollow cylinder, and is further sleeved in the battery sleeve 20. An internal thread 322 is formed on the internal thread sleeve 320 in a position corresponding to the external thread 3162. Therefore, the internal thread 322 and the external thread 3162 are connected to each other by a thread connection, in such a way that the internal thread sleeve 320 and the external thread sleeve 310 are connected to each other.

In the electronic cigarette of the present application, the second through-hole 412 is defined on the side wall of the upper electrode 410. Besides, the inlet channel 210, the first through-hole 312 and the second through-hole 412 are communicated with each other to form a gas flow communication channel. In this way, the gas entering the electronic cigarette successively flows through the first through-hole 312 and the second through-hole 412, and finally flows into the atomization channel. Since the second through-hole 412 is defined on the side wall of the upper electrode 410, the flow path of the gas is shortened when the gas flows from the first through-hole 312 to the second through-hole 412, the gas flow changes more smoothly, the noises produced in the smoking process are reduced, and thus the user experience is improved.

Figure 4:
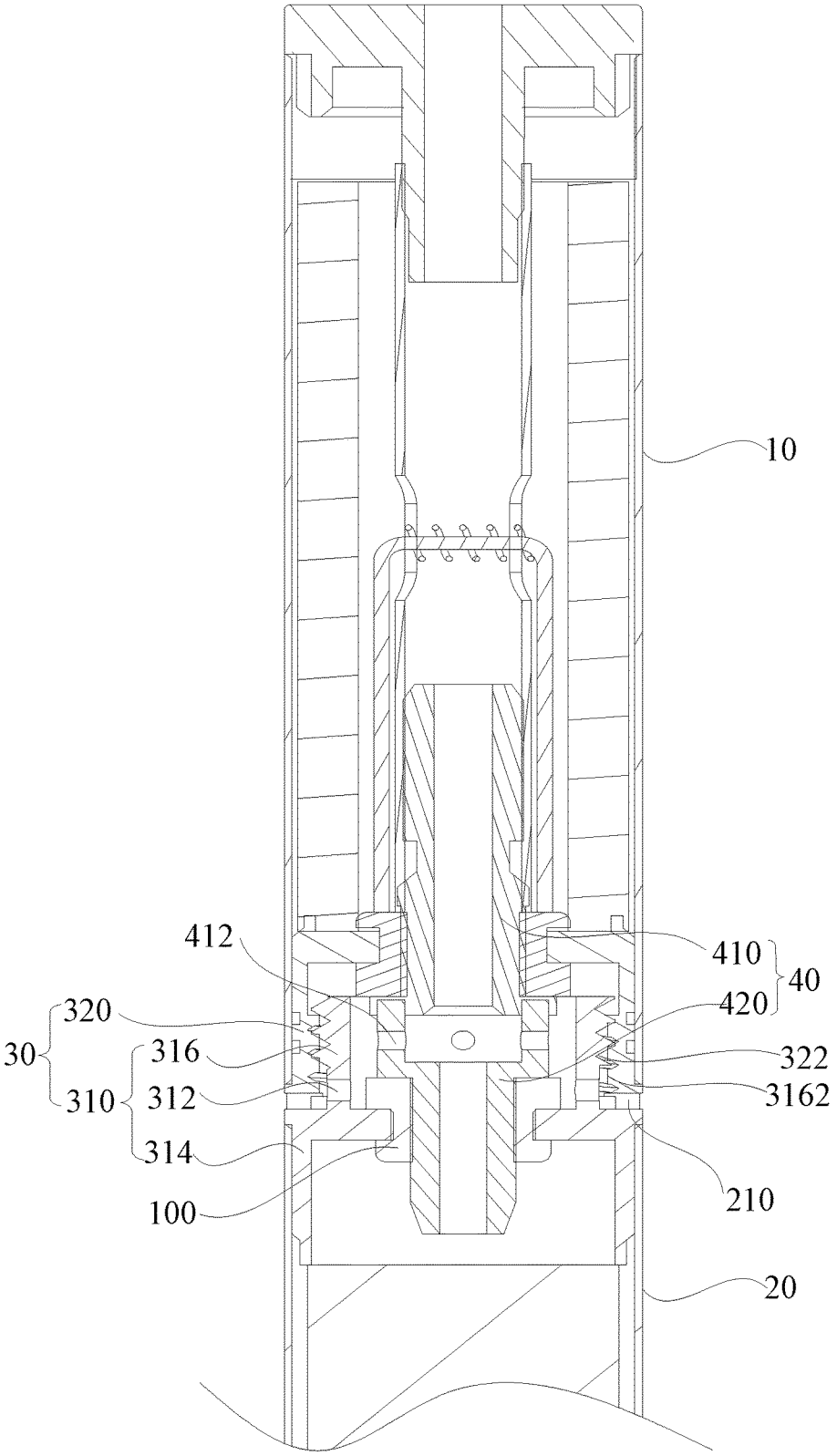
FIG. 4 illustrates a partially cutaway view of an electronic cigarette according to a second embodiment of the present application.
Figure 5:
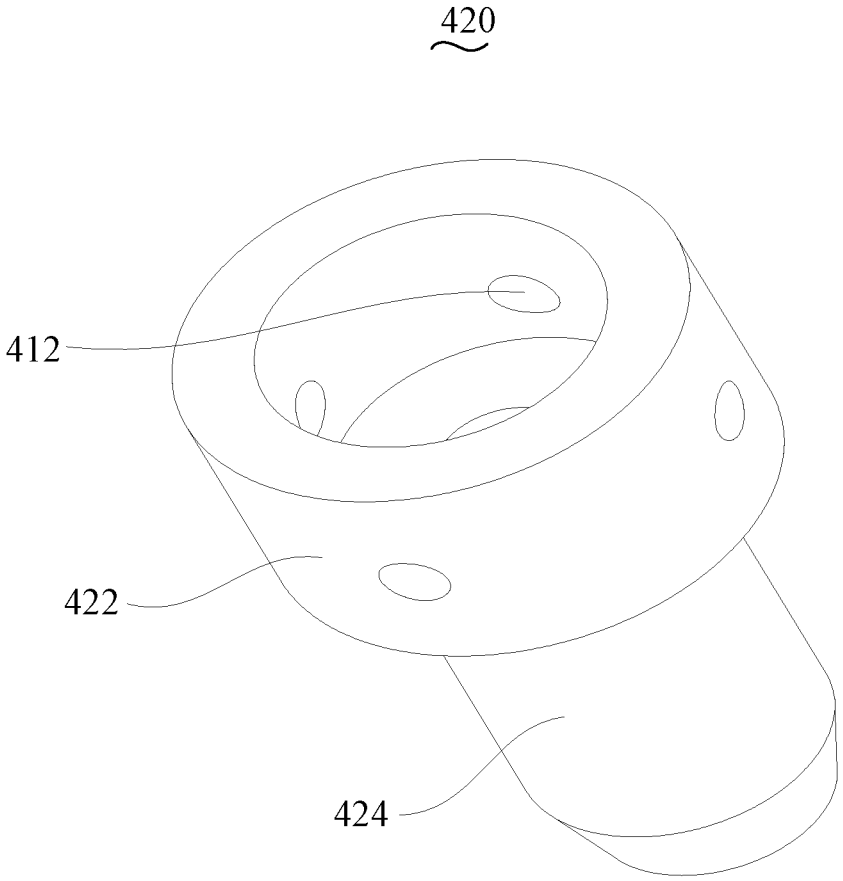
FIG. 5 illustrates a lower electrode shown in FIG. 4.

As shown in FIGS. 4-5, in the electronic cigarette provided in a second embodiment of the present application, the second through-hole 412 is defined on the side wall of the lower electrode 420. In this case, the lower electrode 420 is substantially in shape of a hollow cylinder, and includes a third barrel 422 and a fourth barrel 424. In this case, the fourth barrel 424 extends from an end portion of the third barrel 422, and an inner diameter of the fourth barrel 424 is less than an inner diameter of the third barrel 422, and the third barrel 422 and the fourth barrel 424 have a common axis. Specifically, the second through-hole 412 is defined on the side wall of the third barrel 422. After the gas enters the electronic cigarette from the inlet channel 210, the gas flows through the second through-hole 412 defined on the side wall of the lower electrode 420, and the finally flows into the atomization channel. Compared with the prior art, when using the electronic cigarette of the present application, there is no need for the gas to flow to the bottom end of the lower electrode 420, such that the flow path of the gas is shortened, the drawback that the gas is collided with the atomizer or the battery rod is prevented from occurring, the noises produced in the smoking process are effectively reduced, and thus the user experience is improved.

It could be understood that, one, two, or more second through-holes 412 may be defined in the present application. Therefore, the number of the second through-holes 412 is not limited here, and the number of the second through-holes 412 may be adjusted depending on the requirements to the amount of the smoke when manufacturing the electronic cigarette. In a case that two or more second through-holes 412 are defined in the lower electrode 420, the two or more second through-holes 412 are separately defined on the side wall of the lower electrode 420. In a specific case, the second through-holes 412 may be separated from each other at an equal interval or at an unequal interval. Preferably, a plurality of second through-holes 412 having a same diameter are separately defined on the side wall of the lower electrode 420 at an equal interval.

The external thread sleeve 310 of the present application is substantially in shape of a hollow cylinder, and the lower electrode 420 is disposed inside the external thread sleeve 310. The external thread sleeve 310 includes a main body 314, a connecting portion 316, a joint (not shown here) and a first through-hole 312. In this case, the main body 314 is sleeved in the battery sleeve 20 and is further abutted against the battery sleeve 20. That is, the external thread sleeve 310 is disposed between the battery sleeve 20 and the lower electrode 420. An external thread 3162 is formed on the connecting portion 316, and the joint is formed between the main body 314 and the connecting portion 316. The first through-hole 312 is defined at the joint. The electronic cigarette of the present application further includes a second insulating ring 100. The main body 314 is connected to the forth barrel 424 of the lower electrode 420 via the second insulating ring 100, in such a way that the lower electrode 420 and the external thread sleeve 310 are fixedly connected to each other.

The internal thread sleeve 320 is in shape of a hollow cylinder, and is further sleeved in the atomization sleeve 10. An internal thread 322 is formed on the internal thread sleeve 320 in a position corresponding to the external thread 3162. Therefore, the internal thread 322 and the external thread 3162 are connected to each other by a thread connection, in such a way that the internal thread sleeve 320 and the external thread sleeve 310 are connected to each other.

In the electronic cigarette of the present application, the second through-hole 412 is defined on the side wall of the lower electrode 420. Besides, the inlet channel 210, the first through-hole 312 and the second through-hole 412 are communicated with each other to form a gas flow communication channel. In this way, the gas entering the electronic cigarette successively flows through the first through-hole 312 and the second through-hole 412, and finally flows into the atomization channel. Since the second through-hole 412 is defined on the side wall of the lower electrode 420, the flow path of the gas is shortened when the gas flows from the first through-hole 312 to the second through-hole 412, the gas flow changes more smoothly, the noises produced in the smoking process are reduced, and thus the user experience is improved.

Although the present application is illustrated with the embodiments accompanying the drawings, the present application is not limited to the above-mentioned specific embodiments, and the above-mentioned embodiments are only for illustration, not for limitation. In the inspiration of the present application, those skilled in the art may make many modifications, without going beyond the purpose and the scope the claims intend to protect of the present application. All these belong to the protection of the present application.

The invention claimed is:

1. An electronic cigarette, comprising a casing and an electrode assembly disposed therein; the electrode assembly comprising an outer electrode (30) and an inner electrode (40) which are insulated from each other; wherein the outer electrode (30) is provided a first through-hole (312), and the inner electrode (40) is provided with a second through-hole (412); the first through-hole (312) and the second through-hole (412) are communicated with each other to form a gas flow communication channel of the electronic cigarette;

wherein the casing comprises an atomization sleeve (10) and a battery sleeve (20); an abutment joint between the atomization sleeve (10) and the battery sleeve (20) forms an inlet channel (210) allowing gas to flow into the electronic cigarette;

wherein the outer electrode (30) comprises an external thread sleeve (310) and an internal thread sleeve (320) which are connected to each other by a threaded connection; the first through-hole (312) is defined on an external thread sleeve (310); and wherein number of first through-holes (312) is less than number of second through-holes (412).

2. The electronic cigarette according to claim 1, wherein the gas flow communication channel formed by the first through-hole (312) and the second through-hole (412) is in shape of an arc.

3. The electronic cigarette according to claim 1, wherein the gas flow communication channel formed by the first through-hole (312) and the second through-hole (412) is linear, and an angle between the gas flow communication channel and an axial direction of the casing is less than 90°.

4. The electronic cigarette according to claim 1, wherein the inner electrode (40) includes an upper electrode (410) and a lower electrode (420); the second through-hole (412) is defined on a side wall of the upper electrode (410) or the lower electrode (420).

5. The electronic cigarette according to claim 4, wherein the upper electrode (410) includes a first barrel (414) and a second barrel (416), wherein the second barrel (416) extends from an end portion of the first barrel (414); an inner diameter of the second barrel (416) is less than an inner diameter of the first barrel (414); the second through-hole (412) is defined on the side wall of the first barrel (414).

6. The electronic cigarette according to claim 5, wherein the external thread sleeve (310) includes a main body (314) and a connecting portion (316), the main body (314) is sleeved in the atomization sleeve (10); an external thread (3162) is formed on the connecting portion (316); the first through-hole (312) is defined at a joint between the connecting portion (316) and the main body (314).

7. The electronic cigarette according to claim 6, wherein the electronic cigarette further includes a first insulating ring (80) disposed between the main body (314) and the second barrel (416).

8. The electronic cigarette according to claim 7, wherein the internal thread sleeve (320) is sleeved in the battery sleeve (20); an internal thread (322) is formed on the internal thread sleeve (320) in a position corresponding to the external thread (3162), and the internal thread (322) and the external thread (3162) are connected to each other by a thread connection.

9. The electronic cigarette according to claim 5, wherein at least two second through-holes (412) are defined in the upper electrode (410), and the second through-holes (412) are separated from each other.

10. The electronic cigarette according to claim 9, wherein the second through-holes (412) have a same diameter, and are separately defined on the side wall of the upper electrode (410) at an equal interval.

11. The electronic cigarette according to claim 4, wherein the lower electrode (420) includes a third barrel (422) and a fourth barrel (424), wherein the fourth barrel (424) extends from an end portion of the third barrel (422); an inner diameter of the fourth barrel (424) is less than an inner diameter of the third barrel (422); the second through-hole (412) is defined on the side wall of the third barrel (422).

12. The electronic cigarette according to claim 11, wherein the external thread sleeve (310) includes a main body (314) and a connecting portion (316); the main body (314) is sleeved in the battery sleeve (20); an external thread (3162) is formed on the connecting portion (316); the first through-hole (312) is defined at a joint between the connecting portion (316) and the main body (314).

13. The electronic cigarette according to claim 12, wherein the electronic cigarette further includes a second insulating ring (100) disposed between the main body (314) and the fourth barrel (424).

14. The electronic cigarette according to claim 13, wherein an internal thread (322) is formed on the internal thread sleeve (320) in a position corresponding to the external thread (3162), and the internal thread (322) and the external thread (3162) are connected to each other by a thread connection.

15. The electronic cigarette according to claim 11, wherein at least two second through-holes (412) are defined in the lower electrode (420), and the second through-holes (412) are separated from each other.

16. The electronic cigarette according to claim 15, wherein the second through-holes (412) have a same diameter, and are separately defined on the side wall of the lower electrode (420) at an equal interval.

* * * * *